United States Patent [19]

Lerner et al.

[11] 4,202,153

[45] May 13, 1980

[54] METHOD AND APPARATUS FOR LOADING CONTAINERS HORIZONTALLY

[75] Inventors: Bernard Lerner, Hudson; Dana J. Liebhart, Streetsboro, both of Ohio

[73] Assignee: Automated Packaging Systems, Inc., Twinsburg, Ohio

[21] Appl. No.: 845,114

[22] Filed: Oct. 25, 1977

[51] Int. Cl.[2] ..... B65B 43/36

[52] U.S. Cl. ..... 53/459; 53/469; 53/572; 53/258

[58] Field of Search ..... 53/29, 35, 37, 183, 53/187–190, 258, 384–386, 570, 571, 459, 572, 457, 573, 469; 225/4, 106

[56] References Cited

U.S. PATENT DOCUMENTS

| | | | |
|---|---|---|---|
| 3,145,517 | 8/1964 | Saumsiegle | 53/190 |
| 3,181,956 | 5/1965 | Clark et al. . | |
| 3,254,828 | 6/1966 | Lerner | 53/35 X |
| 3,412,522 | 11/1968 | Schorer | 53/189 |
| 3,490,195 | 1/1970 | Abramson | 53/189 X |
| 3,503,180 | 3/1970 | Myles et al. | 53/258 |
| 3,507,090 | 4/1970 | D'Angelo | 53/570 X |
| 3,552,090 | 1/1971 | Roberts et al. | 53/570 X |
| 3,594,978 | 7/1971 | Spitznagel | 53/385 X |
| 3,619,969 | 11/1971 | Holcombe | 53/570 X |
| 3,628,302 | 12/1971 | Roberts | 53/570 X |
| 3,727,374 | 4/1973 | Williams | 53/189 |
| 3,774,367 | 11/1973 | Lerner | 53/570 X |
| 3,783,580 | 1/1974 | Raudys | 53/29 |
| 3,815,318 | 6/1974 | Lerner | 53/29 |
| 3,908,343 | 9/1975 | Farrelly | 53/570 X |
| 3,971,191 | 7/1976 | Hoyland . | |
| 3,990,625 | 11/1976 | Jellings et al. | 225/106 X |

*Primary Examiner*—Horace M. Culver

*Attorney, Agent, or Firm*—Watts, Hoffmann, Fisher & Heinke Co.

[57] ABSTRACT

A method and apparatus for loading products into horizontally disposed containers is disclosed. The containers are presented sequentially at a loading station, opened, loaded with the product, and removed from the loading station. The containers are included as part of a web which is fed automatically from a supply magazine to the loading station where the containers are severed from the remainder of the web either by the impact of the loading assembly or the products being inserted. A novel method for bag separation is disclosed in which bag separation is effected initially and concurrently near the marginal edge portions of a web and thereafter sequentially inwardly toward a central point. A drive mechanism provides harmonic motion for the loading assembly so that maximum loading speed is attained without damaging the containers.

32 Claims, 21 Drawing Figures

METHOD AND APPARATUS FOR LOADING CONTAINERS HORIZONTALLY

REFERENCE TO RELEVANT PATENTS

1. U.S. Pat. Nos. 3,254,468, "Method of Packaging Articles," 3,254,828, Flexible Container Strips 3,298,580, "Container Delivery Apparatus," and 3,455,088, "Container Delivery Apparatus," all issued to Hershey Lerner, here the Autobag Patents.

2. U.S. Pat Nos. 3,815,318, 3,882,656, 3,956,866, and 4,014,154 each entitled Packaging Method and Apparatus. U.S. Pat. Nos. 3,948,015 entitled Packaging System and 3,965,653 entitled Packaging Apparatus, here the H-100 Patents.

3. U.S. Pat. Nos. 3,774,367, "Apparatus for Packaging Articles," and 3,879,918, "Method for Packaging Articles," both issued to Hershey Lerner, here the Machine Patents.

4. U.S. Reissue No. 28,350, "Bag Handling Apparatus and Method," issued to Bernard Lerner, here the Vacuum Belt Patent.

5. U.S. Pat. No. 3,477,196 "Mechanism for Automatically Feeding, Loading and Sealing Bags," issued to Bernard Lerner, here the Automatic Patent.

6. U.S. Pat. No. 3,956,866 "Packaging Method and Apparatus," issued to Vincent Lattur, here the Lattur Patent.

BACKGROUND OF THE INVENTION

1. Field of the Invention

The invention relates to a method and apparatus for loading articles into containers and, more particularly, to a method and apparatus for loading articles rapidly into horizontally disposed plastic containers without damaging the containers.

2. The Prior Art

The Autobag patents disclose a packaging technique in which a chain of interconnected open plastic bags are used. In the earliest and simplest commercial form a roll of these bags was mounted on a mandrel and the mandrel was positioned in a box. A blower was connected to the box. Bags were fed, closed end first, out of a slot in the box. As the bags exited from the box, air from the blower exiting through the same slot as the bags would inflate each bag as it came out of the box. A product was manually inserted into the inflated bag which was then separated from the chain. The loaded and separated bag was then closed and usually heat sealed.

The dispensing of bags of the type described in the Autobag patents was intially accomplished with disposable shipping containers that also served as dispensing containers. As a next step in the evolution of equipment for effecting packaging with a chain of open bags, manually controlled dispensing machines were developed. These machines were adapted to receive coils of interconnected open bags. The bags were fed through a dispensing opening in the machine vertically downwardly along a path of travel. In a typical operation an operator would manually insert a product, after a bag had been blown open. The operator would then manually separate the bag from the chain of bags and insert the opening of the now loaded bag into a heat sealer. Concurrently with the separation of the now loaded bag the operator would feed the chain of bags to bring the next succeeding bag into the loading station.

More sophisticated relatively automatic equipment has been developed for loading and sealing chains of open bags. An example of such equipment is that disclosed and claimed in the H-100 Patents. With that equipment, bags are automatically fed to the loading station. In addition, they are automatically sealed and separated from the chain after products have been loaded in.

While both chains of bags which have been sold under the trademark AUTOBAG and machines sold under the trademark H-100 by Automated Packaging Systems, Inc. have enjoyed good commercial success, certain products have not been susceptible to automatic insertion into an open bag of the AUTOBAG type. Heretofore, automatic loading has been effected essentially only by gravity feed of products into the bags. While gravity feed is highly successful for many products, it has not proved successful for relatively sharp and heavy products or for relatively soft and bulky items such as pillows and shirts.

Proposals have been made for the loading of relatively large and bulky products. Examples of such proposals are the Machines and the Vacuum Belt Patents. While there have been such proposals, none has been successful for the loading of heavy sharp objects or for the loading of large bulky objects into a chain of bags of the Autobag type. The Machine and Vacuum Belt Patents each teach use of a chain of closed bags which are fed with the lead bag open end first rather than a chain of open bags fed closed end first.

While the problems attendant to loading relatively heavy and sharp products into an open bag of a chain have been alleviated for many products by mechanism disclosed and claimed in the Lattur Patent that mechanism has not been fully successful for all products which ideally should be packaged in plastic bags. In addition, there has been no successful commercial mechanism for "stuffing" relatively large bulky products into bags.

Effective and high speed separation of a loaded bag from a chain of bags has also been a problem. With the initial efforts using shipping containers as dispensers, separation was manually effected. Typically an operation effected such a separation by tearing perforations forming a line of weakness between adjacent bags. A pointed projection was used to initiate the tearing action of a location, transversely speaking, near the center of the line of weakness.

With the earlier reloadable manual dispensing arrangements separation typically was effected by tearing the bag from one side edge toward the other to separate it from the chain. With the H-100 machine this side-to-side separation was made automatic and concurrent with the heat sealing operation.

In an earlier attempt at an automatic machine for loading and sealing bags of a connected chain, a mechanism was devised in which two fingers struck the chain generally at a transverse midpoint of the chain to effect separation of a loaded bag. This mechanism is disclosed more completely in the Automatic Patent. While effective bag separation was achieved, the mechanism disclosed in that patent was not the ultimate solution because among other things it was necessary to effect a relatively accurate registration of a line of weakness in the chain where the separation was to be effected and the fingers which were to effect that separation.

SUMMARY OF THE INVENTION

The present invention provides a new and improved method and apparatus for loading articles into containers at high rates. A container at the end of a web is automatically fed to a loading station where it is supported and opened for loading. An article to be inserted into the container is disposed on a product carrier which is then directed into the open container. The product carrier desirably is tray-like in shape so that it can serve as a guide for the product to be inserted into the container as well as a means to correct slight misorientations in container placement.

A ram also is provided to propel a product from the product carrier as the product carrier approaches or impacts the bottom of the container. The container is connected to the web by a line of weakness in the form of perforations which permit the container to be severed from the remainder of the web upon impact by the carrier or the product.

After the loaded container has been severed from the web, either from impact of the products or the product carrier, and the ram has stripped the product and the container from the carrier, the ram and the product carrier return to a rest position. Another container is advanced to the loading station as the carrier is retracted so that the cycle can be repeated immediately.

In order to avoid damage to the containers and to achieve maximum product loading speed, the product carrier movement, ram stroke, bag thickness, and strength of the line of weakness are coordinated. In addition each container to be loaded is located accurately at the loading station.

Maximum speed and miminum damage is enhanced by supporting the product carrier and the ram on a carriage and by reciprocating the carriage toward and away from the loading station by a drive mechanism which proivdes harmonic motion to the carriage. That is, the product carrier is accelerated from rest to a maximum speed approximately midway through the carriage stroke and then decelerated smoothly immediately prior to impacting the bottom of the container. As the product carrier approaches the container bottom, the ram is actuated to assist the inertia forces acting on the product to propel the product from the carrier. Thereafter, and substantially simultaneously, the ram is retracted, the product carrier is retracted, and a new container is presented at the loading station and opened.

Maximum loading speed without damage to the containers also is achieved by shaping the product carrier in the form of a loading tray having curved side portions adapted to smoothly engage the sides of the container and to conform generally to the contour of the container. In some application a separate guide means is also provided to assist the insertion of large, bulky items into containers. The guide means takes the form of a scoop-like horn, or horns, which in some application are pivoted toward and away from a container being loaded in timed relationship to displacement of the loading tray.

Another feature of the invention is that a very high-speed and reliable separation of a loaded bag from a web is effected. This is effected by arresting web movement to inhibit motion along a path of bag travel. Forces are then applied to a loaded bag while the web is arrested. These forces are applied either by applying a pushing force to an inserted product, by applying forces with the carrier which is used to insert the product into the bag, or both.

In operation, there seems to the naked eye to be concurrent separation of the bag all along a transverse line of weakness connecting the bag to the web. This is especially so with a product which is relatively thin and flat. While in practice there is this appearance of concurrent separation with many products, it is believed what in fact has been achieved is a new process of separation.

With this new process of separation, the first separation occurs at spaced marginal portions adjacent or near sides of the bag. Separation then moves progressively across the line of weakness from the marginal end portions inwardly toward a, transversely speaking, central point. Final separation occurs when separation movement from both sides reaches this central point.

This new separation technique is achieved by controlling the application of forces to the web after the web has been distorted to a condition which causes initial force application to commence separation near both marginal portions. With the preferred arrangement this controlled force application is accomplished by supporting a bag during the loading operation on a relatively flat, generally horizontal support. As the bag is opened, marginal portions of the web are lifted from the supporting surface. Further lifting can occur when the product is inserted into the bag. This is especially true if the product is relatively large and bulky. This lifting places the bag in a condition such that force application longitudinally of the web path of travel effects marginal separtion first.

With this new bag separation technique it is possible to insert a heavy and sharp object into a bag without danger of either puncturing the bag or rupturing the seal which forms the bottom of the bag.

Accordingly the object of the invention is to provide a novel and improved method and apparatus of loading containers, which method and apparatus are especially advantageous for serially loading containers provided in the form of chains of open bags.

Additional advantageous objects and features of the invention will become apparent from the following detailed description of a preferred embodiment of the invention made with reference to the accompanying drawings which form a part of the specification.

DESCRIPTION OF THE PREFERRED EMBODIMENT

Figure 1:
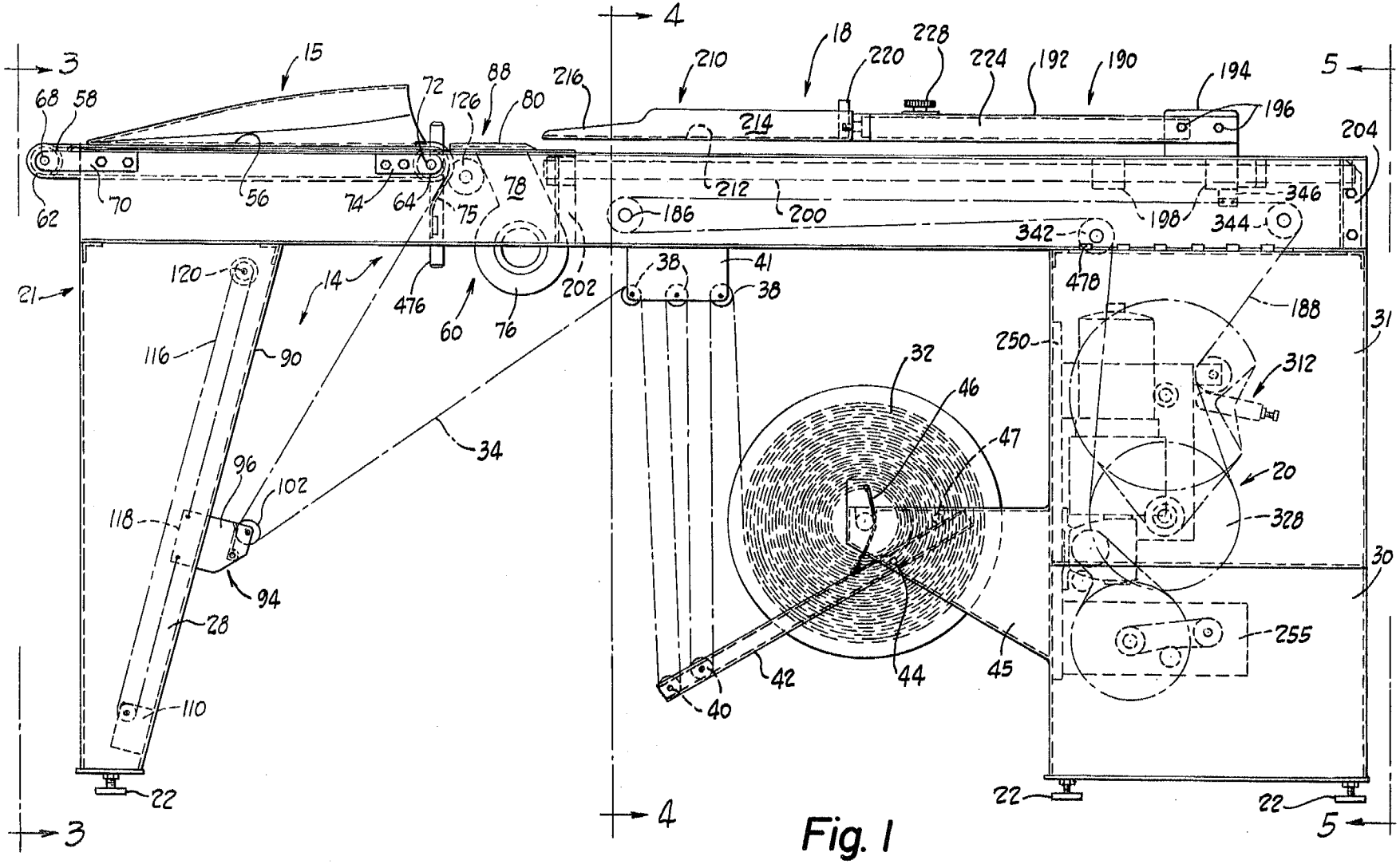
FIG. 1 is a side view, partly in section, of a machine according to the invention having an open container at a loading station.

A loading machine 10 embodying the present invention is illustrated in FIGS. 1–15 of the drawings. The machine 10 includes a container supply magazine 12 from which a web of plastic film material is fed by a feeding mechanism generally indicated at 14. Individual containers 15 are disclosed in the form of a chain of open bags formed from plastic film. These are fed closed end first to, and supported at, a loading station 16, where a product to be loaded may be inserted into the container.

A product carrier assembly 18 advances products to the loading station and inserts the products into the open container. A guide means 19 optionally may be employed to keep the container open while guiding a product past the container entrance. Either the product carrier or the product itself, depending upon the nature of the product, impacts the bottom of the container with sufficient force that the container is severed from the remainder of the web. The product and its surrounding container then are discharged together from the loading station. The feeding mechanism 14 subsequently advances a succeeding container to the loading station 16 to initiate another loading cycle.

The feeding mechanism 15 and the product carrier 18 are powered by a drive mechanism indicated generally at 20. The drive mechanism operates substantially automatically to load a product into an opened container once a start signal has been given. If the machine is being operated manually, the operator must deposit products onto the product carrier; in fully automatic operation, products are deposited by a separate mechanism. In either case, the drive mechanism is actuated after an opened container is presented at the loading station and a product is deposited on the product carrier.

The machine may be used to package virtually anything which can be carried by the product carrier and which can be inserted into appropriately sized containers. Although the size of the product to be packaged ultimately is a function of the size of the machine, it is anticipated that in commercial applications the loading station, and hence the containers, can be up to 24 inches long and 14 inches wide. Depending then upon the thickness of the container material and its composition, whether polyvinyl chloride, polyethylene, polypropylene, or other material, many types of sharp, heavy, or bulky products can be loaded. Typical items would include automobile parts such as brake shoes and large, easily deformable items such as pillows.

In short, virtually any product, other than liquids, can be loaded into containers provided it can be fitted onto the product carrier and into the containers. After the product has been loaded into the containers, the product and the surrounding container move from the loading station to a suitable container closing mechanism such as a heat sealer (not shown) where the opened end of the container is closed and heat sealed or otherwise secured.

Referring now to FIG. 1, the machine 10 is comprised of a frame 21 suitably formed by vertical and horizontal structural members and which is supported by vertically adjustable feet 22. Horizontally extending side rails 24, 26 are disposed along the sides of the frame 21. The side rails 24, 26 are U-shaped when viewed from the end (FIGS. 3 and 4) and provide support for many of the components of the machine 10, including portions of the drive mechanism 20. Vertically extending legs 28, 29 carry one end of the side rails and a housing 30 carries the other end of the rails. The housing 30 isolates certain drive mechanism components and also supports a control box 31. The control box 31 contains electrical components necessary to operate the machine 10 automatically. To better illustrate the invention, protective covers normally used with the machine are not shown.

THE SUPPLY MAGAZINE

The supply magazine 12 houses a coiled container roll 32 in the form of a continuous web or strip 34. The roll 32 is carried rotatably by a support shaft 36 and is located laterally with respect to the shaft by collars 37. The web 34 is trained across rotatable guide rolls 38 and web tensioning dancer rolls 40. The guide rolls 38 are supported from the underside of the rails 24, 26 by depending flanges 41 and the dancer rolls 40 are carried by arms 42 pivotally supported at 44. The arms 42 and the shaft 36 are carried by brackets 45 extending outwardly of the housing 30. A spring 46 is connected intermediate the brackets 45 and the arms 42 to bias the arms 42 upwardly. A stop 47 attached to one of the brackets 45 limits the downward movment of the arms 42 which are shown in their lowermost position. The weight of the dancer rolls 40 and the support arms 42, combined with the counterbalancing effect of the spring 46 properly tensions the web 34 as it unwinds from the roll 32.

Figure 16:
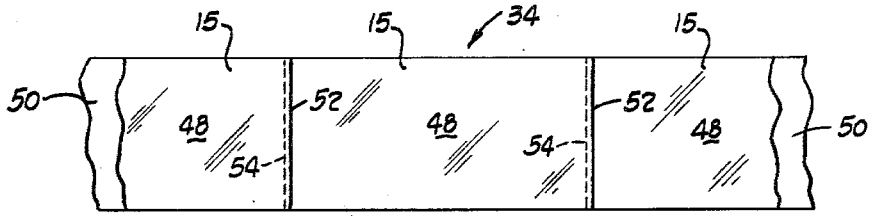
FIG. 16 is a plan view of a web usable with the invention, the web including interconnected, open containers.
Figure 17:
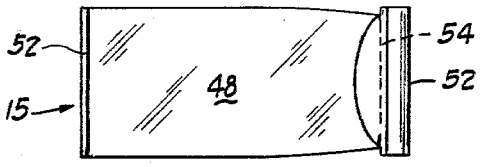
FIg. 17 is a plan view of a container attached to a web and inflated by an airstream for product insertion.

The web 34 (FIG. 16) can be of any suitable construction but it preferably is a flattened tube of plastic, film material which may be formed by two overlying plies 48, 50. The plies are heat-sealed together along transverse lines 52 and serrated along transverse lines 54. These two sets of lines are generally parallel and extend across the web at spaced longitudinal locations. Each heat-seal line 52 provides a container end seal preferably extending completely across the plies 48, 50. Each serrated line 54 also extends completely across the plies and provides a line weakeness in the web for separation of one of the containers 15.

The opened end of each container is formed by separating the perforated portion of the overlying ply 48 along the line 54 so that each container is connected to the end seal of the succeeding container only by the perforated portion of the underlying ply 50. Several of the perforations toward the edges of the ply 50 may also be severed. This permits the containers to be separated easily from the web and also permits each container to be opened to a more oval-like configuration at the loading station.

The web is coiled so that as the containers are removed from the coil 32, the closed end of each container precedes its open end along a path of web travel. The roll 32 also is mounted in the machine appropriately so that the separated or overlying ply 48 is atop the underlying ply 50 when each container is presented at the loading station.

THE LOADING STATION

Containers are fed sequentially from the supply magazine to the loading station where each container is expanded to an open condition for receiving a product. The loading station includes a generally horizontally disposed surface 56, a plurality of band-like conveyors 58 which are longitudinally disposed with respect to the machine 10, and an airflow generator 60.

Figure 2:
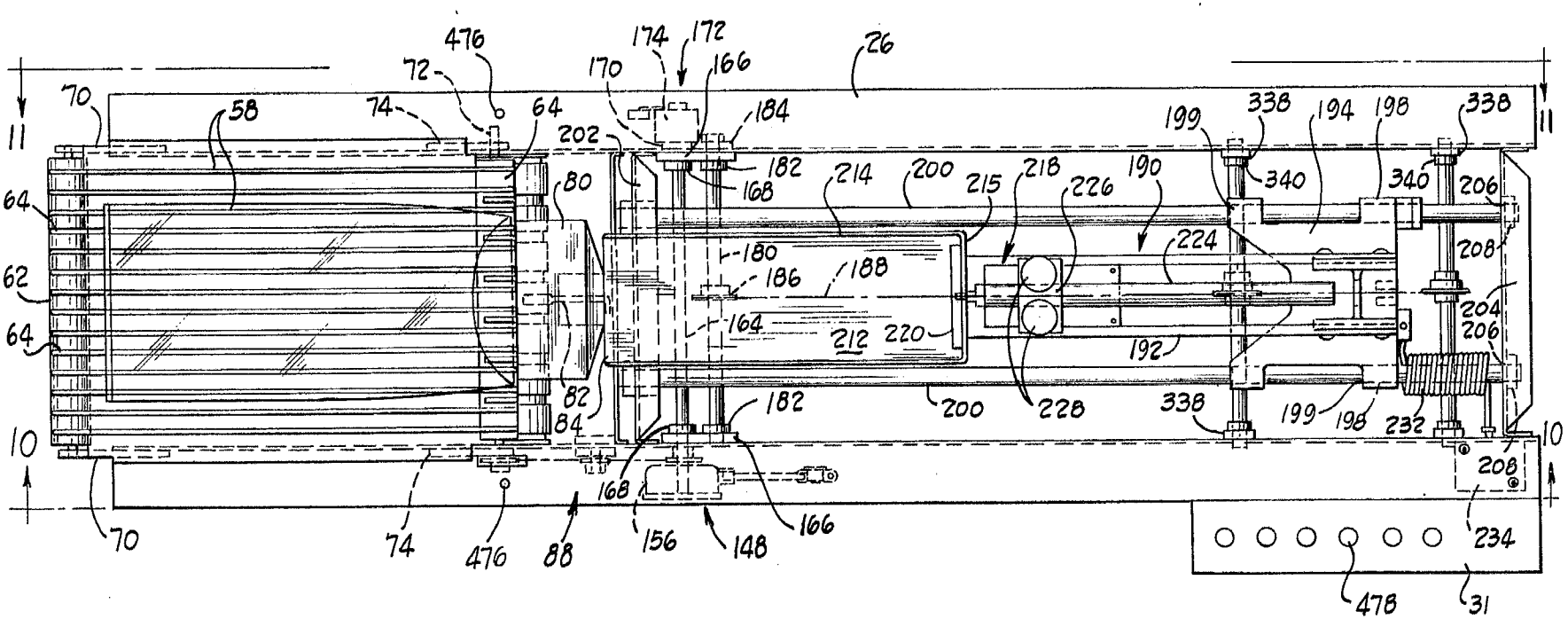
FIG. 2 is a plan view of the machine of FIG. 1.

The horizontal surface 56 comprises a plate extending laterally between the side rails 24, 26 and longitudinally between generally the left end of the side rails, as viewed in FIGS. 1 and 2, and an intermediate portion of the side rails. The surface 56 obviously must be of sufficient size and strength to accomodate filled containers of whatever is being loaded. The surface 56 also must be sufficiently friction-free that the bands 58 encounter little resistance to motion because the belts serve as conveyors to support containers at the loading station and carry loaded containers away from the loading station.

The bands 58 are polyurethane belts each reeved about an idler roller 62 and a feed roller 64. The rollers 62, 64 include circumferential grooves 66 in which the belts ride. The grooves 66 maintain alignment and uniform spacing of the belts 58 as best illustrated in FIG. 2.

The idler roller 62 is supported for rotation on a spindle 68 which, in turn, is carried by tabs 70 projecting forwardly of the side rails 24, 26. The feed roller 64 similarly is carried by a spindle 72 which, in turn, is supported for rotation by tabs 74. The tabs 70, 74 can be adjusted fore and aft to tension the belts 58 as desired.

The centerline distance between the spindles 68, 72 is on the order of 21 inches so that the horizontal surface 56 and bands 58 can accomodate a container up to approximately two feet in length. The lateral dimension of the rollers 62, 64 is approximately 14 inches so that containers more than one foot from edge to edge can be accomdated readily. The foregoing dimensions represent approximate outer limits of bag size which may be accomodated by the machine in its currently realized form, and containers of any combination of smaller dimensions can be loaded by the machine.

Curved fingers 75 extend upwardly around the feed roller to guide containers initially onto the belts. The fingers are disposed intermediate the belts so as not to interfere with motion of the belts.

The airflow generator 60 includes a blower box 76 in which a motor-driven fan (not shown) is disposed. The blower box 76 includes an upwardly extending duct 78 which at its upper end discharges into a horizontally disposed, plate-like nozzle 80. The nozzle 80 discharges rearwardly (to the left in FIG. 1) and directs a low pressure, steady state airstream at the upper, leading edge of the feed roller 64 generally parallel to the surface 56. The nozzle 80 is centered with respect to the roller 64 and extends about two-thirds the span of the roller.

The airflow generator 60 also includes a high pressure nozzle 82 disposed inside of the plate-like nozzle 80 and which discharges rearwardly (to the left in FIG. 2). The high pressure nozzle 82 directs a small, high pressure airstream at approximately the midpoint of the roller 64 at its upper surface. The nozzle 82 is connected to a pressurized source of air by piping 84.

The nozzles 80, 82 combine to open containers as the containers arrive sequentially at the loading station 16. As the previously separated, serrated portion 54 of upper ply 48 passes over the feed roller 64, a high pressure, transient blast of air is discharged from the high pressure nozzle 82 to open the container. Thereafter, a steady-state airstream from the plate-like nozzle 80 maintains the container in an open condition at the loading station.

THE FEEDING MECHANISM

The feeding mechanism 14 includes a perforation locator assembly 86 (FIGS. 12 and 13) and a feed roller drive assembly 88 (FIGS. 1, 2, 10 and 11). These assemblies combine to present containers sequentially and upon command to the loading station where the containers may be opened and loaded. The assemblies also assist in severing containers from the remainder of the web and carrying loaded containers away from the loading station.

The perforation locator assembly 86 comprises spaced, inclined guideways 90, 92 affixed to legs 28, 29 respectively. A roller bracket 94 extends between the legs 28, 29 and is carried by the guideways 90, 92. The roller bracket 94 includes spaced edge portions 96, 98 adapted to receive spindles 100. The spindles 100 support a roller 102 for rotation.

A rod 104 extends between the legs 28, 29 and is disposed near the underside of the side rails 24, 26. The rod 104 is supported for rotation by bearings 106 and carries sprockets 108. Bearing blocks 110 are disposed near the lower portion of the legs and rotatably support a rod 112. Sprockets 114 are carried by the rod 112.

A chain 116 is reeved about each aligned pair of sprockets 108, 114 and is attached at either end to a bracket 118 affixed to the backside of the edge portions 96, 98. A control knob 120 is affixed to one end of the rod 104 so that, upon rotation of the control knob, the roller bracket 94 with roller 102 attached may be moved generally vertically along the guideways 90, 92. The bearing blocks 110 are adjustable vertically to tension the chains 116 as desired.

The perforation locator assembly 86 also includes a ground strap 122 connected at one end to the roller bracket 94. The ground strap 122 may take the form of a finger-like piece of spring steel which is bent sufficiently to lightly contact the roller 102. A current-carrying conductor 124 engages one end of the roller 102 and is carried by the edge portion 96. The conductor 124 is connected to a suitable source of electricity so that the roller 102 may be charged when the machine is in use.

When the machine is in use, the web 34 is disposed intermediate the roller 102 and the ground strap 122.

Because the web 34 is comprised of a plastic material such as polyethylene or polypropylene, and because these materials are nonconductors, a potential difference is maintained between the roller 102 and the ground strap 122. When one of the serrated lines 54 is interposed between the roller and the ground strap the perforations permit electricity to be conducted between them and current therefore flows to ground. The flow of electricity provides a signal which enables control circuitry to discern the location of the containers 15 included as part of the web 34.

By vertical adjustment of the roller 102 through rotation of the control knob 120, the signal provided by the perforation locator assembly 86 can be used to control various machine functions. More specifically, the container opening can be adjusted longitudinally with respect to the loading station 16. In the machine illustrated, the roller 102 is vertically adjustable approximately 20 inches so that a wide range of container lengths can be handled and the container opening always can be placed adjacent the nozzles 80, 82.

The feed roller drive assembly 88 provides intermittent, selective driving motion to the feed roller 64 so that the web may be driven forwardly, and containers presented sequentially at the loading station. The feed roller drive assembly comprises feed roller 64 and a pressure roller 126 which together form nip rolls between which the web is passed. The pressure roll includes circumferential grooves 127 through which the fingers 75 extend. The pressure roller is carried by spindles 128 which, in turn, are supported for rotation by bellcranks 130, 132. The bellcranks 130, 132 are carried by the side rails 24, 26, respectively, and are pivotally mounted as at 134.

Figure 10:
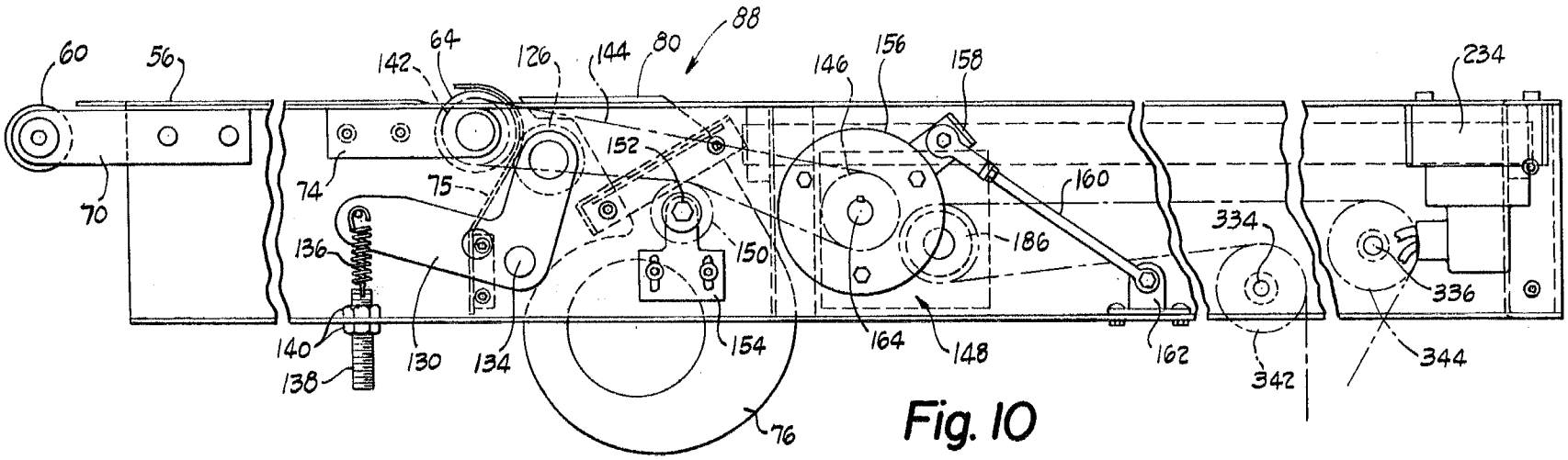
FIG. 10 is a view taken along line 10—10 of FIG. 2, with portions removed, illustrating in more detail one of the side rails.
Figure 11:
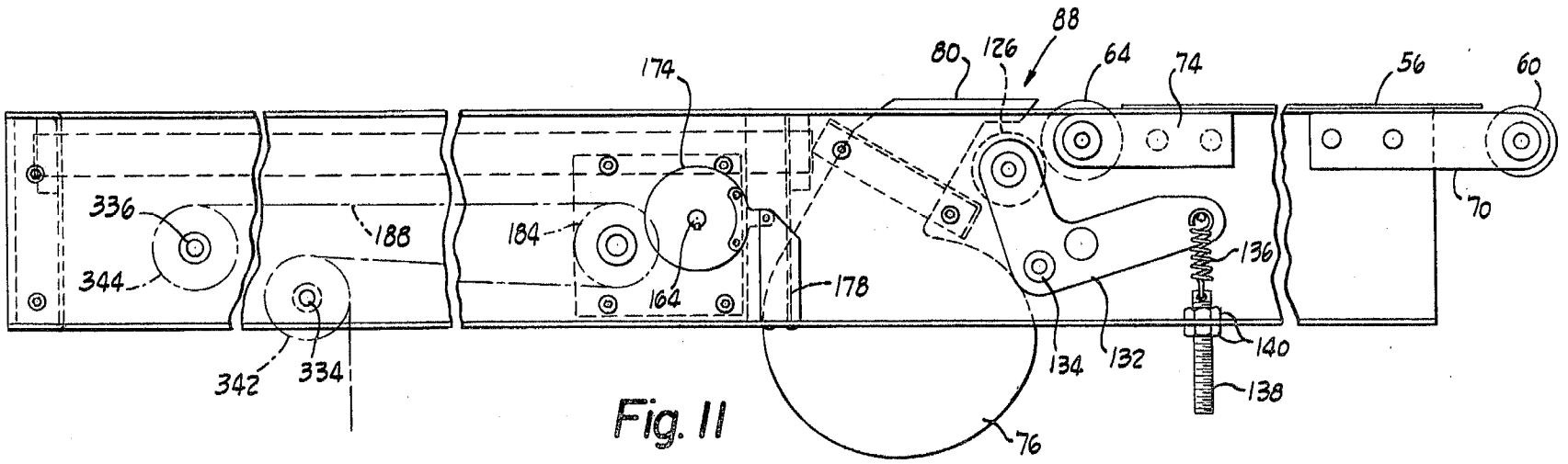
FIG. 11 is an elevational view as seen from the plane indicated by the line 11—11 of FIG. 2, with portions removed, illustrating in more detail the other side rail.
Figure 13:
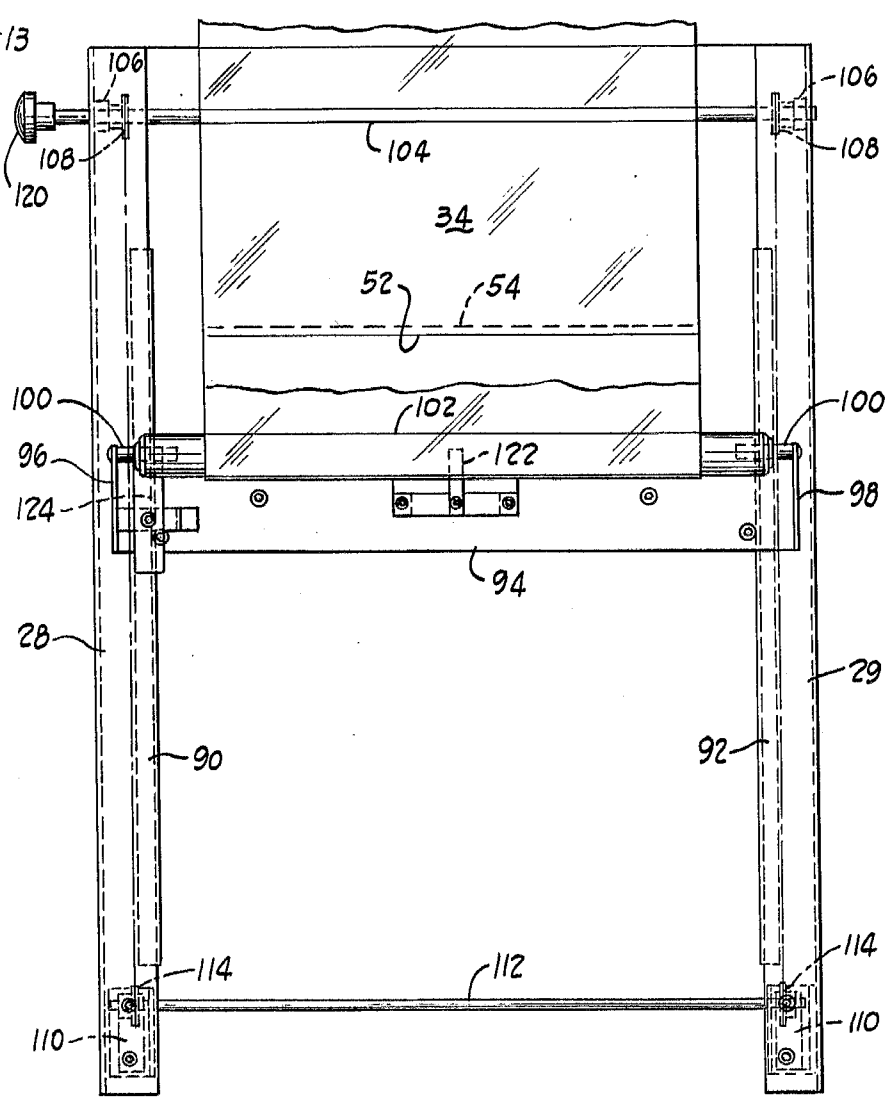
FIG. 13 is a view as seen from the plane indicated by the line 13—13 of FIG. 12 illustrating another view of the perforation locator assembly.
Figure 12:
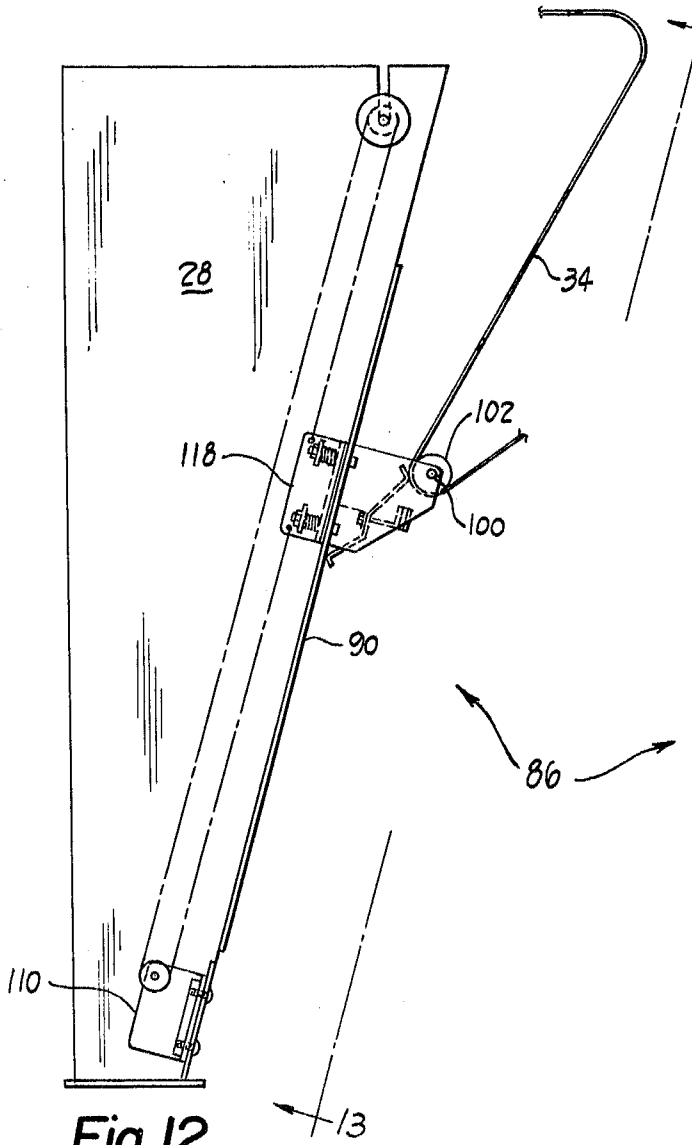
FIG. 12 is a detailed, enlarged view of the perforation locator assembly illustrated in FIG. 1.
Figure 14:
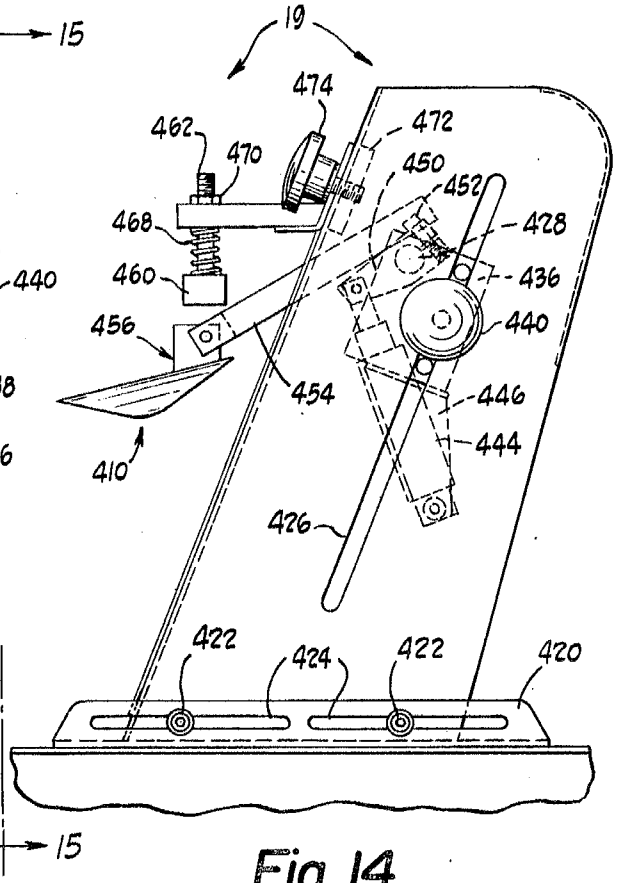
FIG. 14 is an elevational view of a guide means optionally employed with the invention.

The pressure roller is biased into engagement with the feed roller by springs 136 which act on the bellcranks, as best illustrated in FIGS. 10 and 11. One end of each spring is attached to the bellcrank while the other end of the spring is affixed to a bolt 138 passing through a portion of the side rail. Locknuts 140 enable each bolt to be retained at a desired vertical location. By vertically adjusting the bolts, the amount of bias exerted on the bellcranks by the springs can be varied. Consequently, the pressure exerted on containers passing between the rollers 64, 126 can be adjusted as required.

The feed roller 64 includes a sprocket 142 (FIG. 10) about which a chain 144 is reeved. The chain 144 also is reeved about a sprocket 146 included as part of a brake assembly 148. The chain 144 is tensioned by an idler roll 150. The idler roll is supported for rotation by a shoulder screw 152 which, in turn, is carried by a bracket 154. By appropriate vertical adjustment of the bracket 154, the idler roll 150 maybe moved upwardly or downwardly and the chain 144 may be tensioned as desired.

Rotation of the sprocket 146 and, hence, the feed roller, is controlled by the brake assembly 148. The brake assembly may comprise any conventional electrically operated brake capable of restraining shaft rotation when desired, but permitting shaft rotation for short periods upon command. An acceptable commercially available brake assembly is manufactured by the Warner Corporation, Model No. EB-375.

The brake assembly 148 includes an outer housing 156 having an outwardly extending tab 158. A brake rod 160 is connected at one end to the tab 158 and is connected at the other end to the side rail 24 by means of a tab 162. The brake rod anchors the housing 156 so that a braking action may be obtained upon actuation of brake shoes disposed within the housing.

The sprocket 146 and the brake assembly 148 are carried by a shaft 164 extending the width of the machine and supported for rotation in the side rails by bearing blocks 166. The shaft extends outwardly of the side rails a short distance and is maintained in a fixed lateral position by collars 168 rigidly affixed to the shaft. The collars 168 engage the blocks 166 to maintain the shaft position.

A spur gear 170 is carried by the shaft 164 and is disposed on the outside of the side rail 26 as viewed in FIG. 2. A clutch assembly 172 is carried by the shaft 164 and is connected intermediate the shaft 164 and the gear 170. Upon rotation of the gear 170 and selective operation of the clutch assembly, the shaft 164 may be rotated. An acceptable commercially available clutch assembly is manufactured by the Electroid Company, Model No. 5BEC-25C.

The clutch assembly includes an outer housing 174 having a coil disposed internally. A tab 176 is connected to the coil and projects outwardly of the housing. A bracket 178 connects the tab 176 to the side rail 26 to rigidly support the coil against rotation.

A second shaft 180 extends the width of the machine and is supported for rotation by the bearing blocks 166. The shaft 180 extends outwardly of the side rail 26 a short distance and is maintained in a fixed lateral position by collars 182 which are rigidly affixed to the shaft. The collars 168 engage the bearing blocks 166 to maintain the shaft position. The shaft 180 carries a spur gear 184 on the outside of the side rail 26. The gear 184 meshes with the gear 170 in driving relationship.

The shaft 180 also carries a sprocket 186 about which a chain 188 is reeved and which is disposed approximately mid-way between the side rails. The chain 180 is part of the drive mechanism 20. Movement of the chain 188 will cause the gear 184 to rotate. When the gear 184 is rotated counterclockwise, as viewed in FIG. 11, when the clutch assembly is engaged, and when the brake assembly is disengaged, the feed roller 64 will be rotated counterclockwise as viewed in FIG. 10. Consequently, a container passing between the rollers 64, 126 will be advanced onto the belts 58 at the loading station.

In a similar manner, when the clutch assembly is disengaged and the brake assembly is engaged, rotation of the rollers 64, 126 is prevented. Consequently, a now-loaded container at the loading station can be severed from the remainder of the web 34.

THE PRODUCT CARRIER

The product carrier 18 comprises a carriage 190 adapted for recirprocation longitudinally of the machine 10. The carriage 190 is comprised of a rectangular box-like frame 192 affixed at one end to a slide 194; the attachment is made by bolted fasteners 196. The slide 194 includes four outwardly extending legs 198, each having a longitudinally extending opening 199. The legs 198 are in the same horizontal plane and a pair of openings 199 on either side of the slide 194 are aligned.

The slide 194 is supported for fore-and-aft movement by a pair of carriage ways 200 extending between a first bulkhead 202 and a second bulkhead 204. The first bulkhead 202 is disposed approximately mid-way between the ends of the machine and the second bulkhead 204 is disposed near the right end of the machine as viewed in FIG. 2. The bulkheads 202, 204 extend across the machine between the side rails and are affixed rigidly to the side rails as by welding.

The carriage ways 200 are threaded at each end and extend through openings 206 formed in the bulkheads 202, 204. Nuts 208 are threaded onto the ends of the carriage ways 200 to retain the ways firmly in place. This construction lends considerable rigidity to the frame 21.

The diameter of the openings 199 and the diameter of the ways 200 are sized accurately so that the slide 194 may reciprocate readily without excessive looseness. If desired, the openings 199 can be provided with replacable inserts to greatly prolong the life of the parts.

Figure 3:
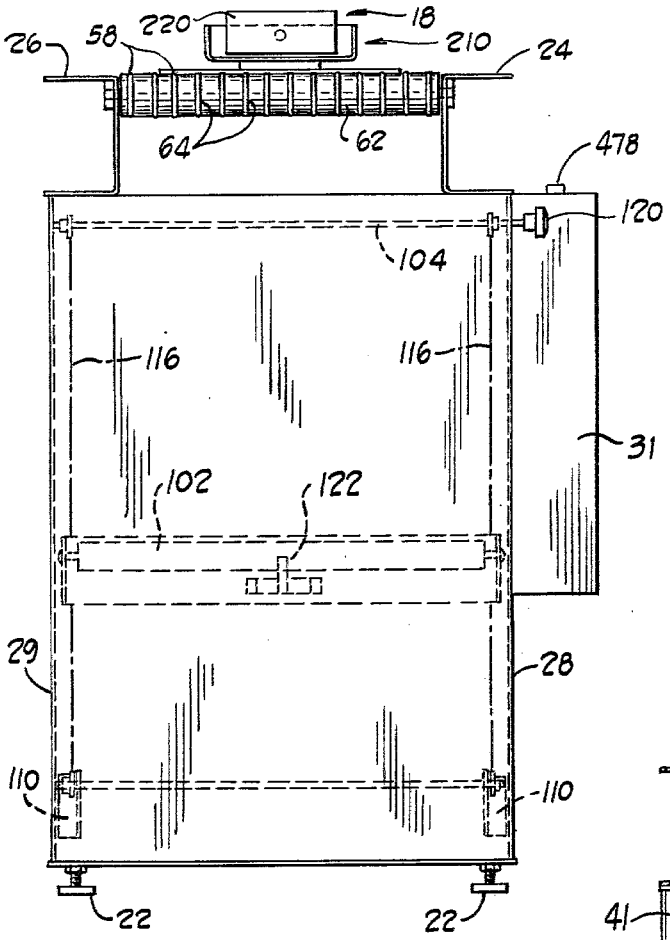
FIG. 3 is an end elevational view seen from the plan indicated by the line 3—3 of FIG. 1.
Figure 4:
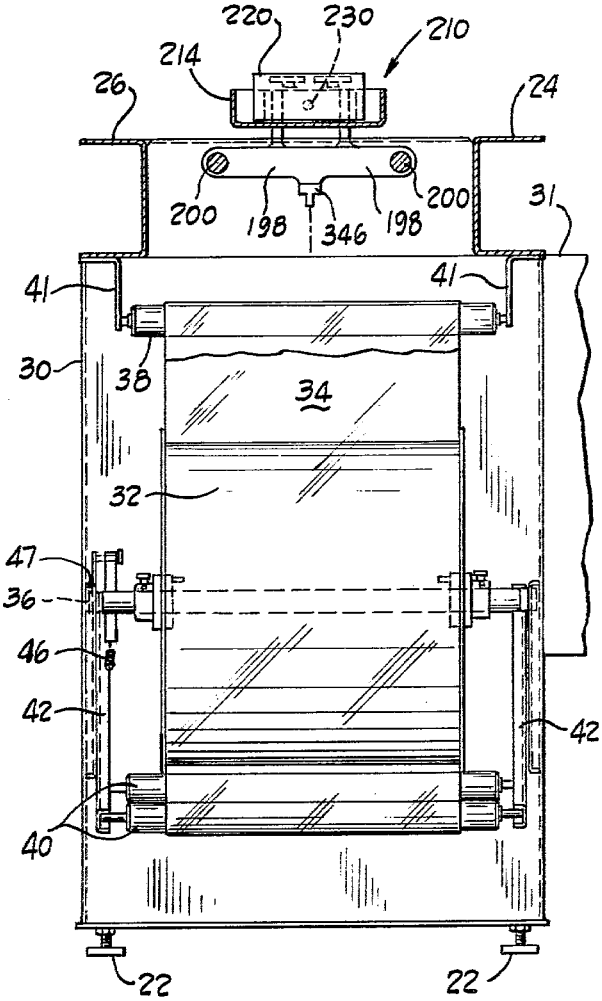
FIG. 4 is a sectional view taken along line 4—4 of FIG. 1 illustrating a portion of the product carrier and the web feeding assembly.

A loading tray 210 is rigidly affixed to the frame 192 at that portion of the frame 192 closest to the loading station. The loading tray 210 is a scoop-like shovel, rectangular in plan view (FIG. 2) and having a flattened bottom surface 212 with upturned sides 214 (FIGS. 3 and 4). As shown the sides 214 preferably are tapered to form a somewhat pointed end portion 216 (FIG. 1). The tray 210 also includes a back wall 215 connecting the sides 214.

In the illustrated embodiment, the loading tray conforms generally to the shape of the container 15 so that the end portion of the loading tray may travel completely to the bottom of the container when the loading tray is extended completely. In short, the product to be loaded into the containers and the shape of the containers will govern the particular loading tray required. This tray shape obviously varys from product to product and container to container. Typically the carrier sides also are shaped to extend vertically over the product and adjust the shape of the bag opening to receive the product.

The frame 192 also carries a stripper assembly 218. The stripper assembly 218 is comprised of a ram 220 carried by a piston rod 222 extending outwardly of an air cylinder 224. The piston rod is biased to a retracted position by a spring disposed within the air cylinder 224. The air cylinder 224 is rigidly affixed within the frame 192.

The piston rod 222 extends through an opening 230 formed in the loading tray backwall 215. A flexible, extensible conduit 232 is coiled about one of the ways 200 and is connected between the backside of the air cylinder 224 and an electrically operated valve 234 (FIG. 10) which permits high pressure air to be supplied to the air cylinder 224 while the cylinder is reciprocated longitudinally of the machine.

Because the air cylinder 224 is rigidly connected to the frame 192 via the bracket 226, the air cylinder, and hence the ram 220, reciprocate simultaneously with the loading tray 210. When high pressure air is supplied to the air cylinder 224, the piston rod 222 and the ram 220 are moved relative to the loading tray 210. When the air pressure is released, the piston rod and the ram are retracted.

In FIG. 2, the loading tray 210 is shown in a first, rest position and the ram 220 is in a first, rest position. Upon displacement of the slide 194 to the left, the loading tray 210 will be in a second, extended position. Regardless of the position of the loading tray 210, the air cylinder 224 may be pressurized to displace the ram 220 to a second, extended position.

The capability to displace the ram 220 independently of reciprocation of the loading tray 210, permits a wide variety of products to be loaded into containers having differing strength characteristics.

THE DRIVE MECHANISM

The drive mechanism 20 is disposed within the housing 30 and provides power to reciprocate the loading tray and sequentially advance the containers. Referring to FIGS. 5–9, the drive mechanism is comprised of a motor 236, a clutch/brake module 238, a speed reducer 240, an harmonic drive mechanism 242, and an output gearing section 244 having a torque limiter 246. The drive mechanism also includes cam-actuated switches 248 for controlling the operation of various machine components.

The drive mechanism components are mounted to a mounting plate 250 which is attached to one of the inside walls of the housing 30. The motor, clutch/brake module, and speed reducer are mounted to the plate 250 by a flanged mounting plate 252 included as part of the speed reducer 240; the attachment is made by bolted fasteners 254. The cam-actuated switches 248 and portions of the harmonic drive mechanism 242 are carried by parallel plates 255, 256 extending orthogonally to the surface of the plate 250. The plates 255, 256 are attached to the mounting plate 250 by bolted fasteners 254. The output gearing section 244, the torque limiter 246, and portions of the harmonic drive mechanism 242 are carried by parallel plates 257, 258 extending orthogonally to the surface of the mounting plate 250. The plates 257, 258 also are attached to the mounting plate 250 by means of bolted fasteners 254.

The motor 236 produces one-quarter horsepower at 1800 revolutions per minute. The motor is operated from a DC source and provides a substantially constant-speed output. The motor can be controlled by conventional circuitry to provide any desired output speed so that the product carrier 18 and the feeding mechanism 14 can be operated to their maximum capabilities consistent with product and container integrity.

The motor 236 powers the clutch/brake module 238. The module permits selective power transmission depending upon whether the clutch is engaged. The module also permits all drive components to be stopped upon application of the brake. Because of this capability, the motor 236 always runs when the machine is in use and a loading cycle can be commenced by energizing the clutch included as part of the clutch/brake module. When a loading cycle is complete, the clutch can be disengaged and the brake applied to provide a positive stop for all moving components of the system. An acceptable commercially available clutch/brake module is manufactured by the Ogura Company, Ltd. Model No. 12-CP.

The output of the module 238 is directed to the speed reducer 240 which gears down the module output speed approximately 20:1. A first reduction is made in a gearbox 260 connected directly to the output of the module 238. The reduction in the gearbox is approximately 20:1. An output shaft 262 extends outwardly of the gearbox 260 and carries a sprocket 264. A vertically extending breather tube 265 vents the gearbox; lubricant foamed during operation of the gearbox can rise in the tube, thus avoiding spillage.

The side plates 255, 256 rotatably support a crankshaft 266. A sprocket 268 is keyed to the crankshaft 266 approximately midway between the side plates 255, 256 and in line with the sprocket 246. A chain 270 is reeved about the sprockets 264, 268.

An idler sprocket 272 is supported for rotation by a shoulder screw 274. In turn, the shoulder screw is affixed to a bracket 276. The bracket 276 is mounted to the side plate 255 and includes a pair of slots 278 through which bolts 280 extend. By appropriate lateral adjustment of the bracket 276, the idler sprocket 272 will engage the chain 270 and tension the chain as desired.

Because the diameter of the sprocket 268 is approximately 3 times the diameter of the sprocket 264, gear reduction of about 3:1 occurs. Taken together, the foregoing elements of the speed reducer 240 yield approximately a 60:1 overall gear reduction between the motor 236 and the crankshaft 266.

The crankshaft 266 also comprises a portion of the harmonic drive mechanism 242. A crank 282 is rigidly affixed to one end of the crankshaft by a split end portion 284. The split end portion 284 is fastened to the crankshaft upon tightening of a bolt 286 which extends through the split portion 284. A collar 288 is rigidly affixed to the crankshaft and is disposed intermediate the side plate 256 and the crank 282 to prevent shifting of the crankshaft.

A connecting rod 290 is attached to the end of the crank 282 by means of a shoulder screw 292. The connecting rod includes a cylindercal center section 294 threaded at each end, and rod ends 296 threaded onto the center section. The eyelet portion of the lowermost rod end 296 is carried by shoulder screw 292 extending outwardly of the crank 282. By this construction, the length of the connecting rod 290 is adjustable to permit proper installation and alignment of drive mechanism components.

The plates 257, 258 rotatably support an upper shaft 298 and a lower shaft 300. Collars 302 are affixed rigidly to the shafts 298, 300 and are disposed on the outside of the plates 257, 258 to prevent lateral shifting of the shafts 298, 300.

A large sprocket 304 is keyed to the shaft 298 approximately midway between the side plates 257, 258. A smaller sprocket 306 is keyed to the lower shaft 300 and is aligned with the large sprocket 304. A chain 308 is reeved about the sprockets 304, 306 to provide power transmission between the two.

Figure 6:
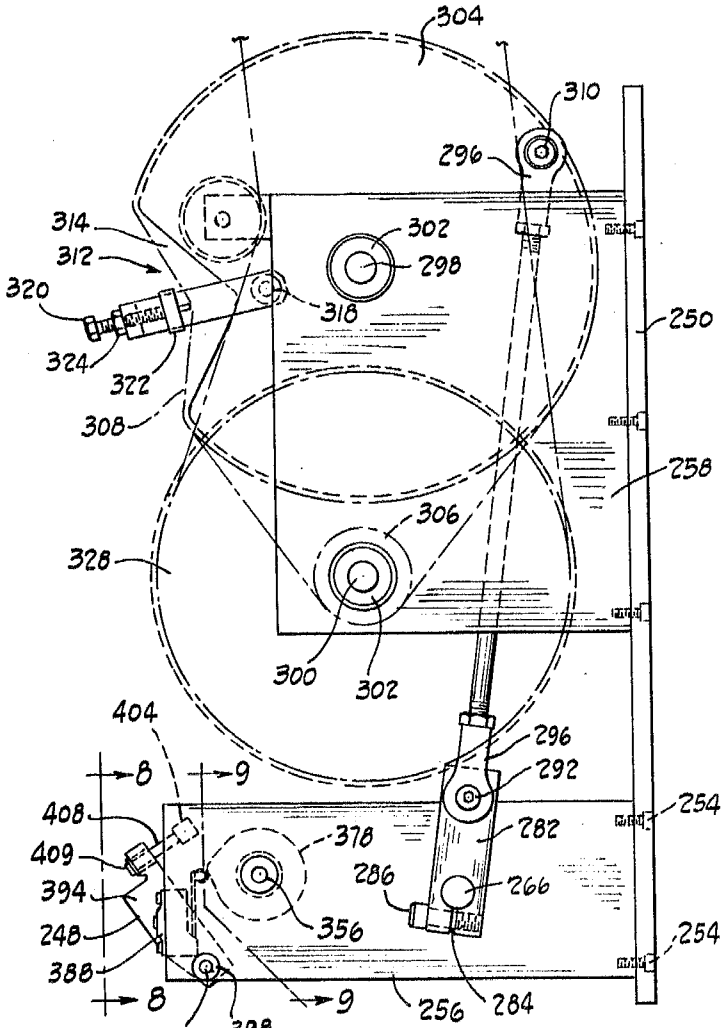
FIG. 6 is an elevational view, with parts broken away and removed, as seen from the plane indicated by the line 6—6 of FIG. 5.
Figure 5:
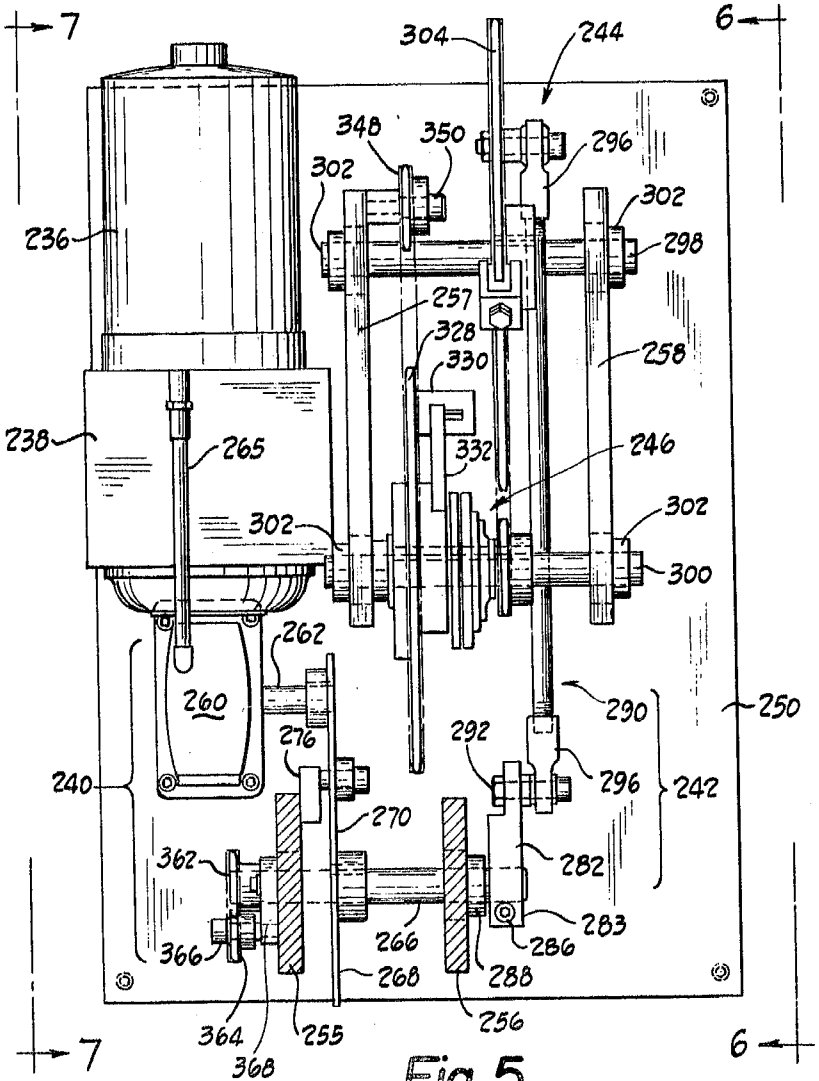
FIG. 5 is an end elevational view of the machine as seen from the plane indicated by the line 5—5 of FIG. 7 on an enlarged scale and with parts broken away and removed to illustrate the arrangement of drive mechanism components.
Figure 7:
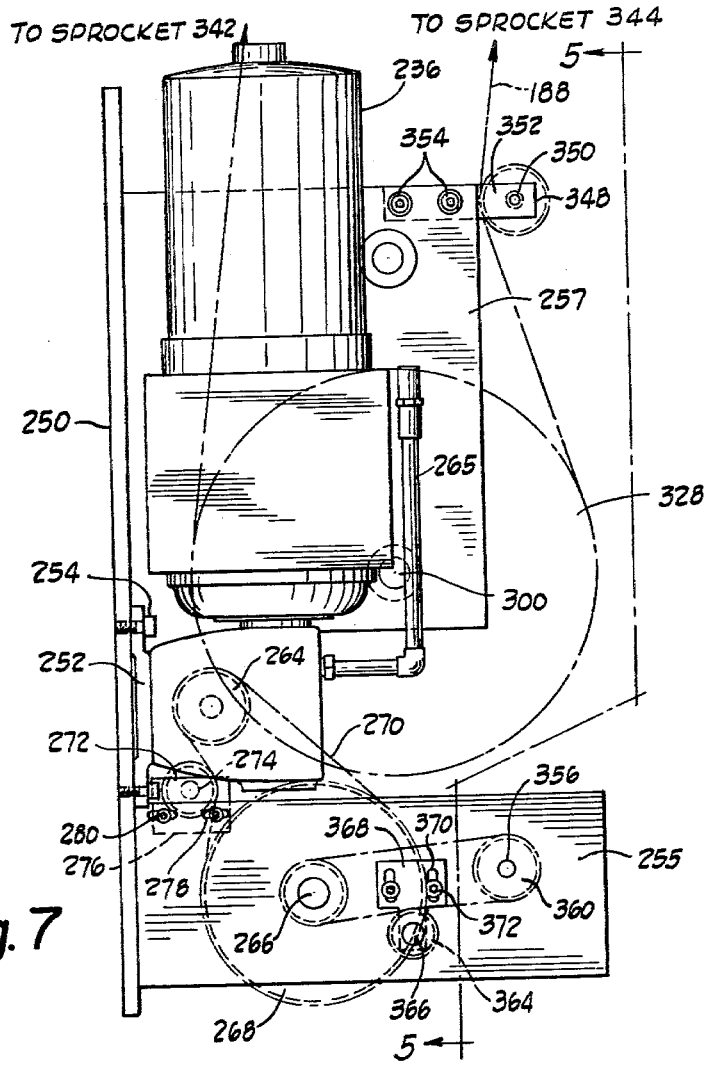
FIG. 7 is an elevational view with parts broken away and removed, as seen from the plane indicated by the line 7—7 of FIG. 5.
Figure 8:
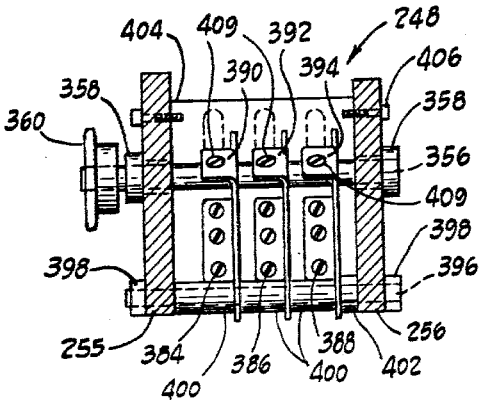
FIGS. 8 and 9 are enlarged sectional views respectively illustrating in more detail certain control elements associated with the drive mechanism.
Figure 9:
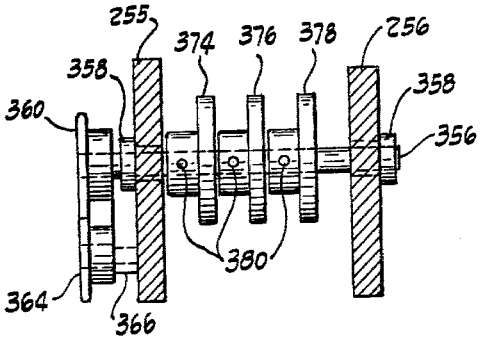

A shoulder screw 310 projects orthogonally from the side of the sprocket 304 and is spaced a small distance from the periphery of the sprocket 304. The eyelet portion of the uppermost rod end 296 is carried by the shoulder screw 310 so that a driving relationship between the crankshaft 266 and the sprocket 304 is established. Referring to FIG. 6 (where the crank 282 is at top dead center) it will be apparent that a complete revolution of the crankshaft 266 will result only in a back and forth, rocking motion of the sprocket 304. The length of the crank 282, the length of the connecting rod 290, the diameter of the sprocket 304, and the centerline distance between the shaft 298 and the shoulder screw 310 are selected carefully so that sprocket 304 rocks a desired amount.

As will be explained in more detail subsequently, the loading tray 210 is displaced toward the loading station when sprocket 304 rotates clockwise (as viewed in FIG. 6) and the loading tray is displaced to its rest position when the sprocket 304 is rotated counterclockwise. In the illustrated embodiment, sprocket 304 rocks back and forth over an arc of approximately 90° and the loading tray 210 has a stroke of approximately 27 inches. These parameters can be adjusted to adapt the machine for loading various products. For example, if the product to be loaded is small and not easily damaged, a loading tray stroke of less than 27 inches may be acceptable. This is because a shorter loading tray stroke permits more products to be loaded in a given period of time than does a longer loading tray stroke.

A chain tightener 312 is provided for the chain 308. The chain tightener 312 comprises an indented portion 314 of the sprocket 304 and a clevis 316 pinned to the sprocket 304 by a fastener 318. The clevis includes a bolt 320 extending through the end portion of the clevis and carrying a clamp block 322 at its end. A locknut 324 is threaded onto the bolt 320 to maintain the bolt, and hence the clamp block, in any desired position with respect to the clevis. By extending the clamp block 322, the chain 308 is engaged and depressed into the indented portion 314 of the sprocket 304. Accordingly, the chain 308 may be tensioned as desired. Because the sprocket 304 only rocks back and forth, no relative motion between the sprocket 304 and the chain 308 can occur. Hence, the chain tightener 312 does not interfere with motion of the drive mechanism.

The output gearing section 244 also includes a torque limiter 246. The torque limiter is carried by the lower shaft 300 and is disposed approximately midway between the plates 257, 258. The torque limiter includes a drive disk 326 having an outwardly extending cylindrical portion 327 keyed onto the shaft 300. An output sprocket 328 is supported for rotation about the cylindrical portion 327.

A spring block 330 projects outwardly from the side of the output sprocket 328. A bellcrank 332 also is carried by the output sprocket 328 and is biased by a spring (not shown) disposed intermediate the upper arm of the bellcrank 332 and the spring block 330. The other end of the bellcrank carries a roller (not shown) which engages a detent in the periphery of the drive disk 326. Because the drive disk 326 is driven by the shaft 300 through the cylindrical portion 327, the drive disk 326 will rock back and forth in response to movement of the sprocket 304. This movement of the drive disk 326 will be transmitted to the output sprocket 328 through the roller and the bellcrank. By appropriate adjustment of the spring block 330, the pressure between the roller and the drive disk can be adjusted so that a desired maximum torque capability can be selected. This serves as a safety feature in the event the drive mechanism inadvertently is jammed.

The chain 188 (FIGS. 1, 2, 10, and 11) is reeved about the output sprocket 328. A pair of shafts 334, 336 are disposed above the drive mechanism 20 and the housing 30. The shafts 334, 336 extend the width of the machine and are supported for rotation in the side rails by bearings 338. The shafts 334, 336 are maintained in a fixed lateral position by collars 340 rigidly affixed to the shafts. The collars 340 engage the bearings 338 to maintain the shaft position.

A sprocket 342 is rigidly affixed to the shaft 334 and is disposed approximately midway between the side rails. Similarly, a sprocket 344 is carried by the shaft 336. A yoke 346 extends downwardly from the slide 194 in alignment with the sprockets 186, 328, 342, and 344. The chain 188 is attached at one end to the yoke 346 and is reeved about the sprocket 344 and thence downwardly into the housing 30 where it is reeved about the sprocket 328. The chain then is reeved about the sprockets 342, 186 and is connected at its other end to the yoke 346. Referring more particularly to FIG. 1, it will be apparent that a rocking motion of the output sprocket 328 will cause the slide 194, and hence the loading tray 210, to reciprocate along the carriage ways 200.

The chain 188 is tensioned by an idler roll 348. The idler roll is supported for rotation by a shoulder screw 350 which, in turn, is carried by a bracket 352. The bracket 352 extends outwardly of the plate 257 and is supported for lateral movement by bolts 354. By appropriate lateral adjustment of the bracket 352, the idler roll 348 may be moved longitudinally of the machine and the chain 188 may be tensioned as desired.

Referring again to FIGS. 5-9, the cam-actuated switches 248 are controlled by the crankshaft 266. A shaft 356 is supported for rotation by the side plates 255, 256 and is displaced a small distance from the crankshaft. The shaft 356 extends outwardly of the side plates 255, 256 a short distance and is maintained in a fixed lateral position by collars 358 rigidly affixed to the shaft. The collars 358 engage the side plates 255, 256 to maintain the shaft position.

The shaft 356 carries a sprocket 360 on the outside of the side plate 255. A sprocket 362 is carried by the crankshaft 266 and is disposed on the outside of the side plate 255 in alignment with the sprocket 360. A chain 362 is reeved about the sprockets 360, 362 to establish a driving relationship between the sprockets.

An idler sprocket 364 is supported for rotation by a shoulder screw 366 which, in turn, is affixed to a bracket 368. The bracket 368 is mounted to the side plate 255 and includes a pair of slots 370 through which bolts 372 extend. By appropriate vertical adjustment of the bracket 368, the idler sprocket 364 will engage the chain 363 and tension the chain as desired.

A plurality of cams 374, 376, 378 are carried by the shaft 356 and are fixed in place on the shaft by set screws 380. The cams engage cam followers 382 included as part of the switches 248. The switches 248 comprise microswitches 384, 386, 388 which are carried by brackets 390, 392, 394, respectively.

The brackets 390, 392, 394 at one end are supported pivotally about a shaft 396. The shaft 396 extends between the side plates 255, 256 and is maintained in a fixed lateral position by collars 398. Spacers 400 and a collar 402 are interposed among the brackets and the side plates to maintain uniform spacing of the microswitches 384, 386, 388.

A spacer 404 extends between the side plates 255, 256 near an upper, forward portion of the side plates. The spacer 404 is maintained in place by fasteners 406 passing through the side plates and into the spacer 404. A plurality of springs 408 and pan head screws 409 are connected intermediate the spacer 404 and the brackets 390, 392, 394. By this construction, the brackets may be biased counterclockwise as viewed in FIG. 6 under the influence of a spring bias. In turn, the cam followers 382 will be biased away from engagement with the cams 374, 376, 378. By appropriate adjustment of the pan head screws 409, however, the cam followers 382 can be urged into engagement with the cams under a controlled amount of pressure to assure proper switching action without undue cam wear.

Set screws 380 permit the cams 374, 376, 378 to be displaced laterally of the shaft 356 so that accurate alignment with the cam followers 382 is possible. Moreover, the set screws 380 permit the cams to be adjusted individually to a desired radial position on the shaft 356 to permit the switches 384, 386, 388 to be actuated individually as a function of the radial displacement of the shaft 356.

THE GUIDE MEANS

The guide means 19 (FIGS. 14 and 15) optionally may be employed with the machine 10 when easily deformable items such as pillows or sponges are being loaded. The guide means 19 comprises a scoop-like horn 410 disposed above the loading station 16, the horn being carried by a frame 412 which straddles the machine.

The frame includes inclined legs 414, 416 joined at their top by an overhead rail 418. Brackets 420 are affixed to the side rails and the legs 414, 416 are connected to the brackets 420 for longitudinal adjustment by fasteners 422 extending through slots 424. The legs 414, 416 include an inclined slot 426 by which the horn 410 may be adjusted vertically.

The horn is carried by a shaft 428 extending across the loading station and disposed generally parallel to the rail 418. The leg 416 carries an adjustment block 430 for vertical movement along its slot 426. The block 430 includes a threaded portion 432 extending through the slot 426 for engagement with a knob 434.

The leg 414 also carries an adjustment block 436 for vertical movement along the slot 426. A threaded portion 438 extends through the slot 426 for engagement with a knob 440. The shaft 428 is supported for rotation at its ends by the adjustment blocks 430, 436. Vertical positioning of the shaft 428, and hence the horn 410, is controlled by the knobs 434, 440 which frictionally engage the legs 414, 416 to maintain a desired vertical placement of the horn 410.

An actuator 442 is employed to pivot the horn 410 about the longitudinal axis of the shaft 428. The actuator 442 comprises an air cylinder 444 connected at one end to the adjustment block 436 by a bracket 446. A piston rod 448 extends outwardly of the air cylinder 444 and is connected to the shaft 428 by an arm 450. The arm is split where it engages the shaft 428 and is tightened about the shaft by a fastener 452.

A horn carrier bar 454 is rigidly affixed to the shaft 428 and is disposed about midway between the legs 414, 416. The horn 410 is pivotally mounted to the end of the carrier bar 454 remote from the shaft 428 by means of a pinned connection indicated at 456. The carrier bar 454 is inclined downwardly from the horizontal so that the horn 410 is positioned toward the loading station.

A horn stop assembly 458 is aligned with the carrier bar 454 and is disposed above the horn 410. Upon actuation of the air cylinder 444, the shaft 428 will be pivoted about its axis and the horn will be forced upwardly. The horn will be moved rapidly until the horn stop assembly 458 is encountered at which point the horn will be stopped abruptly.

The horn stop assembly 458 is comprised of a bumper 460 fixed to the end of a bolt 462. The bolt is supported by an arm 464 extending outwardly of a crosspiece 466. A spring 468 is disposed intermediate the underside of the arm 464 and the top of the bumper 460. To bias the bumper downwardly, a lock nut 470 is threaded onto the bolt to adjust the degree of bias exerted against the bumper by the spring.

The crosspiece 466 is attached to the legs 414, 416 at each end by a clamp 472. Knobs 474 are threaded to the clamps 472 and compress the clamps against the legs to frictionally retain the crosspiece at a desired vertical location. By appropriate vertical adjustment of the crosspiece 466, the bumper 460 can be positioned above the horn 410 at the desired location and the maximum upward displacement of the horn can be controlled accordingly.

The guide means may be employed after a container has been presented at the loading station and opened. Upon actuation of the air cylinder 444, the horn 410 will be pivoted upwardly so that the top surface of the horn will engage the underside of the overlying ply 48 at the container entrance. Consequently, a smooth, inclined surface is presented to products being inserted into the container, and misalignment between the product and the container is avoided. This considerably speeds production because large, easily deformable products will not catch on the container edges and a fully automatic loading can be accomplished.

Figure 15:
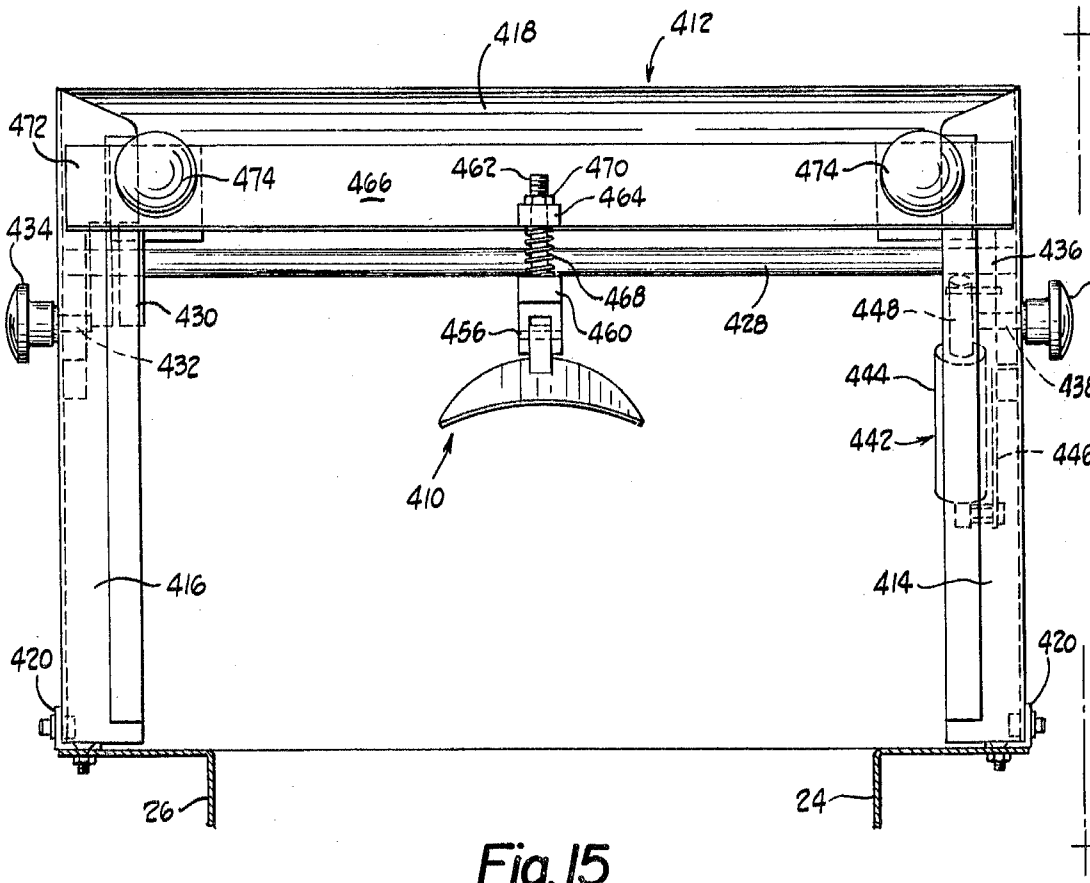
FIG. 15 is an elevational view as seen from the plane indicated by the line 15—15 of FIG. 14 illustrating another view of the guide means.

The horn 410 can be contoured appropriately to open the container 15 to its greatest dimension and also act on the product to insure that the product fits within the container opening. The horn stop assembly 458 can be adjusted vertically to whatever position is required so that the proper container opening is achieved. For example, if a product cylindrical in cross section is being loaded, the horn 410 may be formed in a generally curvilinear contour as indicated in FIG. 15. If a somewhat flat product is being loaded, the horn 410 may be formed with a generally planar bottom surface.

The illustrated guide means 19 operates about an axis disposed generally horizontally. If desired, guide means operating about a generally vertical axis also can be employed. The mounting for such a guide means is indicated in FIGS. 1 and 2 by posts 476. A pair of horns similar to horn 410 can be pivotally supported by the posts to enable containers disposed at the loading station to be acted on from the sides. These horns would operate in a manner analogous to that illustrated in FIGS. 14 and 14 and, accordingly, are not shown here. Products which are exceptionally difficult to load may require the use of the overhead horn 410 and the laterally positioned horns. Regardless, the horns would cooperate in the manner already described and in timed relationship with the opening of a container to enable the product to be guided and inserted into the container.

OPERATION

Figure 18:
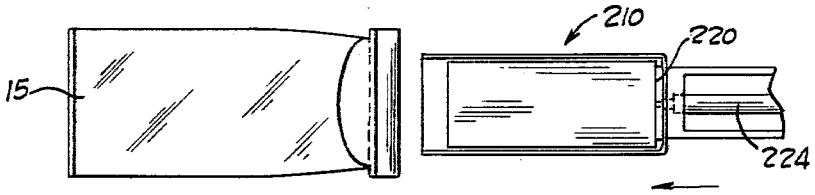
FIGS. 18–21 illustrate schematically sequential steps in the loading of an object into a container and separating it from the web according to the invention.

Loading of a container 15 is indicated schematically in FIGS. 18–21. In FIG. 18 a product to be loaded has been deposited onto the loading tray 210 and the loading tray and the ram 220 are in their retracted positions ready to commence a loading cycle.

At this point a start signal is given, either by a foot pedal (not shown), a starter button 478 on the control box 31, or automatically by a timer mechanism disposed within the control box 31. In response to the start signal, the clutch portion of the clutch/brake module 238 is engaged and power is conveyed from the motor 236 to the crankshaft 226. Because the clutch/brake module has very little inertia, the crankshaft is rotated with very little delay after the start signal has been given.

The crank 282 is moved from its top dead center position illustrated in FIG. 6 and rotated clockwise so that the sprocket 304 also is rocked clockwise. Assuming that the inertia of the product carrier 18 does not exceed the maximum torque capability of the torque limiter 246, the loading tray 210 will be accelerated toward the loading station 16. Due to the nature of the harmonic drive mechanism 242, the loading tray is accelerated from rest to maximum speed approximately midway through the loading stroke (when crank 282 has rotated approximately 90°). As the crank continues to rotate, the loading tray will be decelerated gradually toward the end of the loading tray stroke. This occurs when the crank 282 is at bottom dead center after 180° of rotation.

A plot of loading tray speed versus displacement theoretically would be a sine wave. Departures from the theoretical would occur only because of mechanical considerations such as blacklash in drive mechanism components which would distort the plot at the beginning and end of the loading tray stroke (every 180° of crankshaft rotation).

The harmonic drive mechanism greatly increases the loading capabilities of the machine because delicate products are subjected to gradual acceleration during loading, and container damage is avoided since the loading tray is moving slowly at the end of its stroke when impact occurs. If an air cylinder, for example, were employed to displace the loading tray, the advantageous results arising from use of an harmonic drive mechanism very likely could not be achieved. That is, if a rapidly acting air cylinder were used to maintain production speed, products and containers would be adversely affected. Conversely, if a slower-acting air cylinder were employed, damage to products and containers would be avoided but production speed would suffer. The harmonic drive mechanism 242 thus permits maximum loading speed at minimum risk of damage to the products and the containers.

It has been discovered that loading containers can be severed from the remainder of the web along the line of perforations 54 either by impacting the bottom of the containers with the tapered end portion 216 of the loading tray 210 or by propelling the product from the loading tray so that the product itself impacts the container and severs it from the web. During this procedure the remainder of the web is restrained so that container severance can be effected.

Web restraint is achieved by preventing rotation of the rollers 64, 126 between which the web is passed. Through trial and error, the bias exerted by springs 136 on the rolls 64, 126 is adjusted so that proper web restraint is achieved without excessively compressing the web. A certain amount of web compression is needed because the rollers 64, 126 also form a part of the feeding mechanism 14; the rollers must be compressed sufficiently that the inertia of the supply magazine 12 can be overcome to permit rapid feeding of a succeeding container.

Throughout the initial portion of the loading cycle from when the loading tray first is accelerated until the container 15 has been severed, the feed roller 64 is prevented from rotating by actuation of the brake assembly 148. Energization of the brake assembly is controlled by the perforation locator assembly 86 which produces an electrical signal whenever a perforation line 54 is interposed between the ground strap 122 and the roller 102. By appropriate vertical adjustment of the roller bracket 94, this signal can be given every time a container arrives at the loading station. This is illustrated in FIG. 1. The brake assembly remains engaged until the container has been severed, at which time a release signal is given. The release signal is given simultaneously with actuation of the clutch assembly 172 as will be described subsequently.

Figure 19:
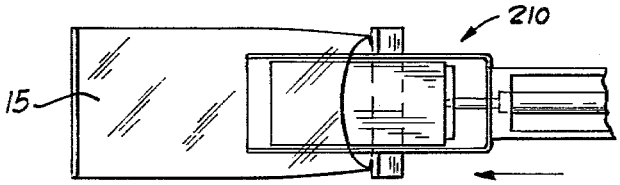
Figure 20:
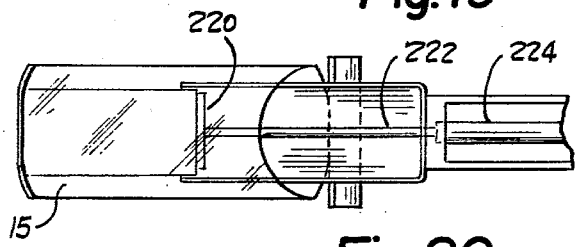

As illustrated in FIG. 19, the loading tray 210 almost has reached the end of its stroke and the ram 220 has commenced its movement to its extended position (FIG. 20) to assist the inertia forces action on the product. In FIG. 20, the product largely has been displaced from the loading tray and has started to impact the bottom of the container. Alternatively, the placement of the container can be adjusted by the perforation locator assembly and the loading tray stroke can be adjusted so that the tapered end portion 216 engages the bottom of the container before movement of the ram is initiated. In either case, a force is exerted against the bottom of the container upon impact and the container is severed from the remainder of the web along the line of perforations 54.

Perforation breakage commences in portions near the edges of the web and then advances inwardly from both portions toward the center. Because the perforations are broken serially, the force needed to sever the container is less than that required if the perforations were broken simultaneously. Accordingly, thinner containers can be used than otherwise might be required. This perforation breakage technique also is compatible with the harmonic motion of the loading tray because the loading tray desirably has almost stopped by the time it or the product impacts the bottom of the container.

The ram 220 is displaced with respect to the loading tray 210 whenever the air cylinder 224 is pressurized. Pressured air is directed to the cylinder upon actuation of the valve 235 associated with the coupling box 234. The valve is controlled electrically by a limit switch (not shown) mounted to the side rail 24. The limit switch is adjustable longitudinally of the machine so that the ram can be displaced whenever desired during its reciprocation with the loading tray. The optimum timing of the ram extension obviously will vary from product to product and container to container and the operator must experiment with the ram timing to achieve minimum container or product damage consistent with maximum loading speed.

Figure 21:
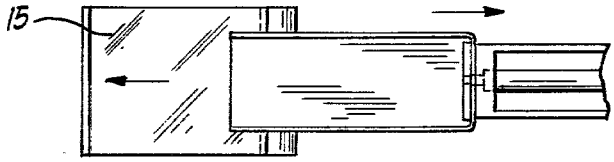

After container severance has been effected, and substantially simultaneously, the brake assembly 148 is disengaged, the clutch assembly 172 is engaged, and the loading tray 210 is retracted to its rest position. A new container then is presented at the loading station while the loading tray is being retracted (FIG. 21). Displacement of the loading tray is brought about by continued clockwise crank rotation from bottom dead center back to top dead center. The microswitch 388 provides an electrical signal to disengage the brake assembly and activate the clutch assembly. Because the cam 378 controls operation of the microswitch 388, the contour and placement of the cam 378 will control the timing of the brake and clutch.

The sprockets 360, 362 are of the same diameter so that the cams 374, 376, 378 will rotate once for every revolution of the crankshaft 266. Accordingly, the cam 378 can be adjusted to initiate the required brake and clutch functions once every loading cycle after container severance has occurred.

Immediately after engagement of the clutch and disengagement of the brake, power is transmitted from the shaft 180 through the shaft 164 to the feed roller 64. This causes the belts 58 to be advanced with the further result that a loaded container is assisted in being removed from the loading station. Continued rotation of the feed roller 64 advances a succeeding container to the loading station. As mentioned previously, feed roller rotation will continue until the brake assembly is activated by a signal from the perforation locator assembly.

The signal from the perforation locator assembly also is used to activate the transient high pressure blast of air from the nozzle 82. A new container presented at the loading station thus is opened a very short period of time after it has arrived at the loading station and it is maintained in the opened condition by the steady state airflow through the nozzle 80. The steady state airflow also assists in properly placing each container at the loading station before all of the container is at the loading station. That is, the nozzle 80 directs a stream of air generally parallel to the horizontal surface 56 and this tends to keep the containers pressed against the belts 58 as the containers are presented at the loading station.

In order to achieve optimum production speed, the crank 282 must begin and end each loading cycle as close to top dead center as possible. This is brought about by activation of the brake portion of the clutch/-brake module 238 as the crank 282 nears its top dead center position. A signal from the microswitch 386 is employed to activate the brake portion of the module. The timing of this signal can be controlled by appropriate adjustment of the cam 376 in a manner analogous to adjustment of the cam 378.

If the guide means 19 is employed with the machine, the horn 410 must be extended shortly after the container has been opened at the loading station and the horn 410 must be retracted shortly after container severance. Air pressure to control the cylinder 444 is regulated by a valve (not shown) which in turn is operated by a signal from the microswitch 384. The timing of this signal can be controlled by appropriate adjustment of the cam 374 in a manner analogous to adjustment of the cams 376, 378.

It will be appreciated that virtually every component of the machine 10 is adjustable in its operation. This permits the machine to be tailored to load virtually any solid product into containers of varying size, shape, thickness, and composition. Excellent control over bag severance is possible with the result that maximum loading speed can be attained with container and product damage reduced to a minimum. In part, this is brought about by the harmonic drive mechanism.

Although only certain portions of the control components have been illustrated, it is believed that the foregoing description is sufficient to enable one skilled in the art to operate the machine. All of the electrical components necessary to operation of the machine are readily available commercially and can be adapted in a manner well known in the art to achieve the results described above.

Although the invention has been described with a certain degree of particularity, it will be appreciated that the present disclosure of the preferred embodiment has been made only by way of example. Various modifications, adaptations and uses of the invention may occur to persons skilled in the art to which the invention pertains and it is intended in the appended claims to cover all such modifications, adaptations, and uses which come within the true spirit and scope of the invention.

What is claimed is:

1. A method of loading a container, comprising:

(a) providing a tubular web having a container portion connected to the web along a line of weakness, the container portion having a sealed end part and an opposite end part provided with a transverse opening;

(b) advancing the web in one direction along a path of travel to position the container portion at a loading station;

(c) opening the container portion while the container portion is connected to the web;

(d) placing a product to be loaded into the container portion onto a product carrier positioned at a first position;

(e) displacing the product carrier in a direction generally the same as said one direction into a second, extended position where the carrier extends into the opened container portion;

(f) pushing the product to be packaged from the carrier into the container portion; and, (g) restraining the web and separating the container portion from the restrained web with forces applied to the container portion by a selected one of the carrier and the product after the performance of step d and prior to the completion of step f.

2. The method of claim 1, wherein the step of pushing the product to be loaded from the carrier comprises the steps of:

(a) disposing a ram adjacent the carrier when the carrier is in the second position; and (b) displacing the ram with respect to the carrier toward the container portion as the carrier nears the second position.

3. The method of claim 1, wherein the carrier is driven by an harmonic drive mechanism such that maximum carrier speed is achieved generally midway through the carrier stroke.

4. The method of claim 1, wherein;

(a) the container is advanced to a location where the carrier extends into the container, but does not engage the bottom of the container; and (b) the product is pushed from the carrier as the carrier nears the extended position, whereby the product alone impacts the bottom of the container and severs the container from the web.

5. The method of claim 1, wherein the web restraint is accomplished by the steps of:

(a) advancing the web between nip rolls; and (b) braking the nip rolls to restrain web movement prior to severence of the container from the web.

6. The method of claim 1 wherein the product carrier, when in the extended position, engages the bottom of the container portion such that the product carrier commences severance of the container portion from the web.

7. A method of loading a container, comprising:

(a) providing a flexible container strip having a plurality of interconnected containers, each of the containers having a sealed end portion and an opposite end portion provided with a transverse opening, the containers being oriented in the same direction with the opposite end portion of one container being connected to the sealed end portion of an adjacent container;

(b) advancing the strip end-wise in the direction of the selaed end portion of the containers to position the containers sequentially and one at a time at a loading station;

(c) opening a positioned container while the container is connected to the strip;

(d) disposing a product on a loading tray;

(e) displacing the loading tray from a product receiving position to a position extending into the open container;

(f) pushing the product to be packaged from the loading tray; and, (g) separating the opened container from the succeeding container after the performance of step d and prior to the completion of step f.

8. The method of claim 7, wherein the loading tray, when in the extended position, engages the bottom of the container such that displacement of the loading tray commences severance of the container from the succeeding container.

9. The method of claim 8, wherein the product is pushed from the loading tray shortly after the loading tray impacts the bottom of the container to assist the now-loaded container in being removed from the loading station.

10. The method of claim 7, wherein the web restraint is accomplished by the steps of:

(a) advancing the container strip between nip rolls; and (b) braking the nip rolls to restrain container strip movement prior to severance of the container from the succeeding container.

11. The method of claim 7, wherein the step of pushing the product to be loaded from the loading tray comprises the steps of:

(a) disposing a ram adjacent the loading tray;

(b) reciprocating the ram simultaneously with reciprocation of the loading tray and generally along the same path of travel; and (c) displacing the ram with respect to the loading tray toward the container as the loading tray nears the extended position.

12. The method of claim 7, wherein the step of opening the positioned container comprises introducing an airstream through the transverse opening, the airstream being introduced by causing it to impinge on the strip in the direction of end-wise strip movement.

13. The method of claim 7, comprising the additional steps of:

(a) engaging the opened container with a guide means before the loading tray reaches the extended position with the guide means being disposed at an angle to the container opening to guide the product being loaded into the opened container; and (b) retracting the guide means to a rest position substantially simultaneously with the displacement of the loading tray from the extended position to its product receiving position and separation of the container from the container strip.

14. A method of packaging comprising:

(a) feeding a web along a path of travel to position a bag forming a portion of the web at a loading station;

(b) inserting a product into the positioned bag after the bag has been opened;

(c) restraining the web to inhibit web movement; and (d) separating the bag from the web by applying force to a line of weakness joining the bag to the web while the web is so restrained, the force application effecting the separation concurrently and initially from spaced marginal side portions of the web thereafter progressively and concurrently effecting further separation along the line at locations transversely inwardly from both side portions toward a generally central point where bag separation is completed.

15. The process of claim 14 wherein the bag is supported generally horizontally during the separation step.

16. The process of claim 14 wherein the marginal side portions are moved out of the path of travel during at least one of the bag opening and product insertion steps.

17. The process of claim 16 wherein the marginal portions are moved out of said path during the opening step and moved further out of the path during the insertion step.

18. A method of packaging comprising:

(a) feeding a web, in the form of a chain of interconnected, open, plastic bags, along a path of travel with the bags being fed closed end first to position the end bag of the chain at a loading station;

(b) opening the end bag;

(c) inserting a product into the end bag after it has been opened and while it is at the loading station;

(d) restraining the chain to inhibit movement of the chain;

(e) separating the loaded end bag from the chain by applying force to the line of weakness joining the end bag while the chain is so restrained, the force application effecting the separation concurrently and initially from spaced marginal side portions of the web and thereafter progressively and concurrently effecting further separation along the line at locations transversely inwardly from both side portions toward a generally central point where bag separation is completed; and (f) closing the loaded and separated bag.

19. The process of claim 18 wherein the bag is supported generally horizontally during the separation step.

20. The process of claim 18 wherein the marginal web portions are moved out of the path of travel during at least one of the bag opening and product insertion steps.

21. A method of packaging comprising:

(a) feeding a web along a path of travel to position a bag forming a portion of the web at a loading station;

(b) inserting a product into the positioned bag after the bag has been opened;

(c) moving marginal portions of the positioned bag out of said path as the bag is opened;

(d) restraining the web to inhibit web movement; and (e) separating the bag from the web by applying force to a line of weakness joining the bag to the web while the web is so restrained to separate the marginal portions initially and thereafter separation advances sequentially inwardly toward a center part of the line.

22. A method of packaging comprising:

(a) feeding a web, in the form of a chain of interconnected, open, plastic bags having open and connected faces, along a path of travel with the bags being fed closed end first with at least an end bag being generally in a plane as it is fed to a position at a loading station;

(b) opening the end bag by moving its open face and at least marginal portions of its connected face out of the plane;

(c) inserting a product into the end bag after it has been opened and while it is at the loading station; and, (d) separating the loaded end bag from the chain by applying force to a line of weakness joining the end bag to the chain, the force being applied while the bag is so opened, the force application effecting the separation concurrently and initially from spaced marginal side portions of the end bag and thereafter progressively and concurrently effecting further separation along the line of weakness transversely inwardly from both side portions toward a generally central point where bag separation is completed.

23. The process of claim 22 wherein the web is restrained during the separation step and separation forces are applied during conclusion of the product insertion step by pressing a selected one of the product and a loading tray against the closed end of the end bag.

24. A packaging apparatus comprising:

(a) structure establishing a loading station and a web supply path;

(b) the structure including a web feeding mechanism along said path for feeding a web in a form which includes at least one open bag adjacent a lead end of the web, the feeding mechanism including means to position such one bag at the loading station and to open the bag;

(c) a product insertion assembly connected to the structure and including product insertion mechanism adapted to move along a portion of the path to insert a product into such open bag at the loading station;

(d) the apparatus including adjustment means for relatively moving the assembly and the load station along said path to adjust relatively an extreme position of product insertion mechanism and the loading station.

(e) a power drive connected to the insertion mechanism and the structure to effect motion of the insertion mechanism; and, (f) one of said mechanisms including a web tensioning means for applying tension to the web to effect bag separation as a part of the product insertion process when the insertion mechanism has been moved to the loading station.

25. The apparatus of claim 24 wherein said tensioning means includes a brake mechanism for permitting movement of such end bag while restraining movement of at least an adjacent portion of the remainder of the web.

26. The apparatus of claim 24 wherein said power drive coacts with the web tensioning means through the product insertion assembly to supply bag separation forces of such end bag.

27. The apparatus of claim 24 wherein the load station includes a relatively flat bag support and wherein the feeding mechanism includes means to open such end bag and as it opens such bag to move marginal portions into spaced relationship with the bag support.

28. The apparatus of claim 24 wherein the power drive is an harmonic drive.

29. A packaging apparatus comprising:

(a) structure establishing a loading station and a web supply path;

(b) the structure including a web feeding mechanism along said path for feeding a web in a form which includes at least one open bag adjacent a lead end of the web, the feeding mechanism including means to position such one bag at the loading station and to open the bag;

(c) a product insertion assembly connected to the structure and including product insertion mechanism adapted to move along a portion of the path to insert a product into such open bag and the loading station;

(d) a power drive connected to the insertion mechanism and the structure to effect motion of the insertion mechanism;

(e) the product insertion assembly including a tray having sides tapering upwardly from a relatively pointed end to elevated portions adapted to assist in bag opening;

(f) the insertion assembly also including a ram mechanism for moving a product off the tray; and, (g) the web feeding mechanism including a conveyor at least partially defining said load station and adapted to transport a loaded and separated bag away from the station.

30. The apparatus of claim 29 wherein the web feeding mechanism includes a conveyor at least partially defining said load station and adapted to transport a loaded and separated bag away from the station.

31. A packaging apparatus comprising:

(a) structure establishing a loading station and a web supply path;

(b) the structure including a web feeding mechanism along said path for feeding a web in a form which includes at least one open bag adjacent a lead end of the web, the feeding mechanism including means to position such one bag at the loading station and to open the bag;

(c) a product insertion assembly connected to the structure and including product insertion mechanism adapted to move along a portion of the path to insert a product into such open bag and the loading station;

(d) a power drive connected to the insertion mechanism and the structure to effect motion of the insertion mechanism; and, (e) the web feeding mechanism including a conveyor at least partially defining said load station and adapted to transport a loaded and separated bag from the station.

32. A packaging apparatus comprising:

(a) structure establishing a loading station and a web supply path;

(b) the structure including a web feeding mechanism along said path for feeding a web in a form which includes at least one open bag adjacent a lead end of the web, the feeding mechanism including means to position such one bag at the loading station and to open the bag;

(c) a product insertion assembly connected to the structure and including product insertion mechanism adapted to move along a portion of the path to insert a product into such open bag and the loading station;

(d) a power drive connected to the insertion mechanism and the structure to effect motion of the insertion mechanism;

(e) the product insertion assembly including a tray having sides tapering upwardly from a relatively pointed end to elevated portions adapted to assist in bag opening;

(f) the insertion assembly also including a ram mechanism for moving a product off the tray; and, (g) the ram mechanism being connected to the tray for movement with it and the ram mechanism includes means to displace a product from the tray after the tray has commenced its movement toward the load station.

* * * * *